United States Patent [19]

Jantzen

[11] Patent Number: 4,812,113

[45] **Date of Patent: * Mar. 14, 1989**

[54] MOLD ASSEMBLY FOR PRE-STRESSED CONCRETE RAILROAD TIES

[76] Inventor: Steven L. Jantzen, 208 S. State St., Jerseyville, Ill. 62053

[ * ] Notice: The portion of the term of this patent subsequent to Dec. 15, 2004 has been disclaimed.

[21] Appl. No.: 110,731

[22] Filed: Oct. 21, 1987

Related U.S. Application Data

[60] Division of Ser. No. 930,514, Nov. 14, 1986, Pat. No. 4,781,875, which is a continuation of Ser. No. 779,804, Sep. 24, 1985, abandoned, which is a continuation of Ser. No. 550,370, Nov. 10, 1983, abandoned.

[51] Int. Cl.[4] ..... B28B 7/16

[52] U.S. Cl. ..... 425/111; 249/86; 425/62; 425/436 R

[58] Field of Search ..... 264/228, 333; 249/86; 294/67.5, 81.61, 87.1; 414/416, 420, 422, 626, 639; 425/62, 111, 436 R, 436 RM, 439; 238/1, 29

[56] References Cited

U.S. PATENT DOCUMENTS

| | | | |
|---|---|---|---|
| 1,022,763 | 4/1912 | Willenborg | 414/639 X |
| 3,608,163 | 9/1971 | Harford | 425/111 X |
| 3,666,385 | 5/1972 | Baker | 425/111 |
| 4,149,306 | 4/1979 | Tice | 264/228 |
| 4,242,071 | 12/1980 | Stinton | 425/111 |

*Primary Examiner*—Robert B. Reeves
*Assistant Examiner*—Scott H. Werny
*Attorney, Agent, or Firm*—Henry W. Cummings

[57] ABSTRACT

Prestressed concrete railroad ties are formed in molds which are supported by existing track near the area where they are to be installed. Each mold will form a number of ties. Reinforcing strands are located within a plurality of longitudinally spaced molds. Concrete is then poured into the molds and the ties are formed bottoms up in the molds. A group of ties are simultaneously removed from a given mold by a special extractor which first simultaneously clamps the reinforcing strands extending outwardly from a given mold, and then lifts the strands as a group from the mold by a suitable crane. Preferably the center of gravity of ties is spaced from a pivot point which will cause 180° rotation locating the ties in upright position to be loaded on a railway car or other vehicle to take them to the site where they are to be installed.

6 Claims, 4 Drawing Sheets

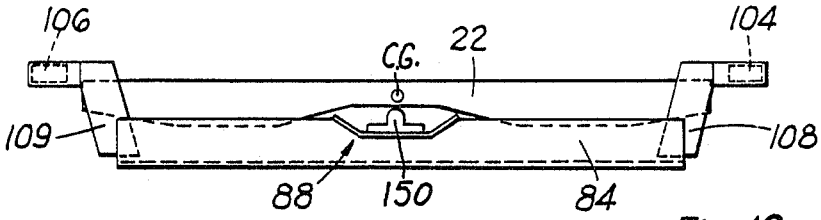
Fig. 12
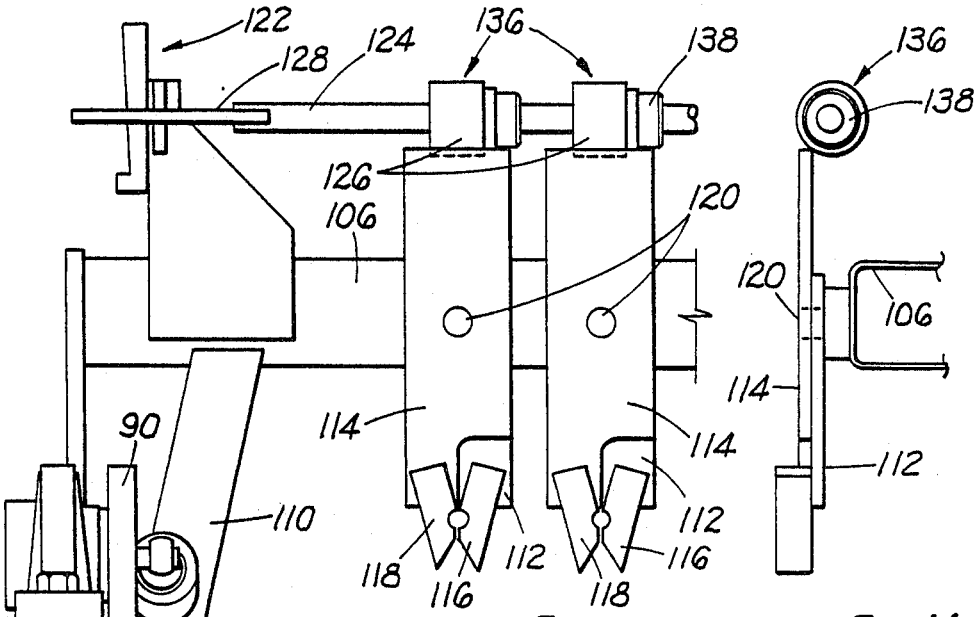
Fig. 10
Fig. 11
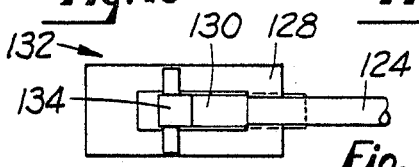
Fig. 13
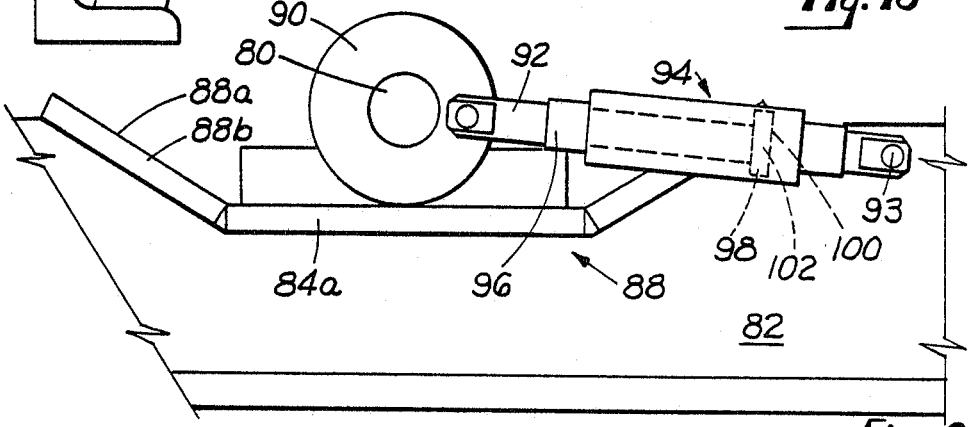
Fig. 9

MOLD ASSEMBLY FOR PRE-STRESSED CONCRETE RAILROAD TIES

This is a division of application Ser. No. 06/930,514 filed Nov. 14, 1986, now U.S. Pat. No. 4,781,875 which is a continuation of application Ser. No. 06/779,804 filed Sept. 24, 1985, now abandoned, which was a continuation of application Ser. No. 06/550,370 filed Nov. 10, 1983, also abandoned.

BACKGROUND OF THE INVENTION

This entails expensive plant construction costs.

Furthermore it is necessary to ship the ties to the installation site. This is an expensive step.

One object of the invention is to provide a way of manufacturing prestressed concrete ties using the long line method without going to the expense of constructing a fixed plant.

Another object is to provide a concrete tie production method and apparatus which greatly reduces the cost of shipping the ties to the installation site.

Another object is to provide a mold assembly for constructing the ties.

Another object is to provide an extractor for removing the cast ties from the mold.

SUMMARY OF THE INVENTION

Prestressed concrete railroad ties are formed in molds which are supported by existing track near the area where they are to be installed. Each mold will form a number of ties. Reinforcing strands are located within a plurality of longitudinally spaced molds. Concrete is then poured into the molds and the ties are formed bottoms up in the molds. A group of ties are simultaneously removed from a given mold by a special extractor which first stimultaneously clamps the reinforcing strands extending outwardly from a given mold, and then lifts the strands as a group from the mold by a suitable crane. Preferably the center of gravity of the ties will automatically rotate 180° to locate the ties in upright position to be loaded on a railway car or other vehicle to take them to the site where they are to be installed.

The transverse end portion of each mold defines cavities longitudinally to receive the pre-stressed ties and slots to receive the strands. The bottom of the mold is contoured to provide a desired tie cross section which varies in a manner designed to carry the compressive and tensile loads applied to the tie by the wheels of rail cars and at the same time minimize the amount of concrete required. The reinforcements are located within the ties at a position to minimize stress fluctuations which occur across the tie. Longitudinal spacer means separate individual tie mold patterns. Lateral stabilizing and/or crane support means are provided at each side of the molds.

The extractor comprises a pair of laterally spaced vertically extending yoke arms which are jointed by a transversely extending support beam. A pair of laterally extending yoke shafts are integrally connected to each vertical yoke. Laterally spaced extractor side beams include vertically foreshortened portions which receive rotatable disks or wheels integrally connected to the yoke shafts. Connecting rods eccentrically attached to the wheels are pivotably mounted upon the extractor side beams and cushioning means are preferably provided to cushion the movement of the connecting rods.

At each end of the extractor a transverse beam extends transversely across the extractor. A fixed link and a movable link are each attached to the transverse beam. Each link includes a depending finger having a slot to receive a reinforcing strand. A pair of links and a pair of fingers are provided for each strand.

Actuating means for moving the movable links and thus the movable fingers into engagement with the fixed fingers is provided. The actuating means may include a rod connected to an opposite end portion of each movable link. Means are provided for moving the rod such as to pivot the movable links about the beam and move the movable finger into engagement with the fixed finger.

In one embodiment the rod is connected at one end to a yoke having a slot and wedge means are provided to be inserted into the slot to move the rod transversely of the extractor and pivot the movable links about the beam. Resilient means are preferably provided between adjacent movable links to provide that the force applied to each movable link is generally about the same. After the movable fingers are moved into engagement with the fixed fingers and with the group of reinforcing strands, the crane means lifts the extractor and the group of ties from the mold.

The extractor preferably includes support means attached to the extractor beam which allows the extractor to rest on the mold prior to employing the actuator to clamp the strands.

Preferably the support means are located on each end of the beam and are located at a level above the beam such that with the ties in place in the extractor, the extractor and ties are biased to a second position 180° from the first position with the ties in the second position in the upright position and ready for transfer to the point of use.

DRAWINGS

FIG. 9 is a side elevation view of the extractor of the present invention.

FIG. 10 is an end elevation view illustrating fixed and movable clamped members.

FIG. 11 is an end view of FIG. 10.

FIG. 12 is a view of the mold including end portions used to pivot about the center of gravity.

FIG. 13 is a plan view of FIG. 10.

DESCRIPTION OF PREFERRED EMBODIMENTS

Figure 1:
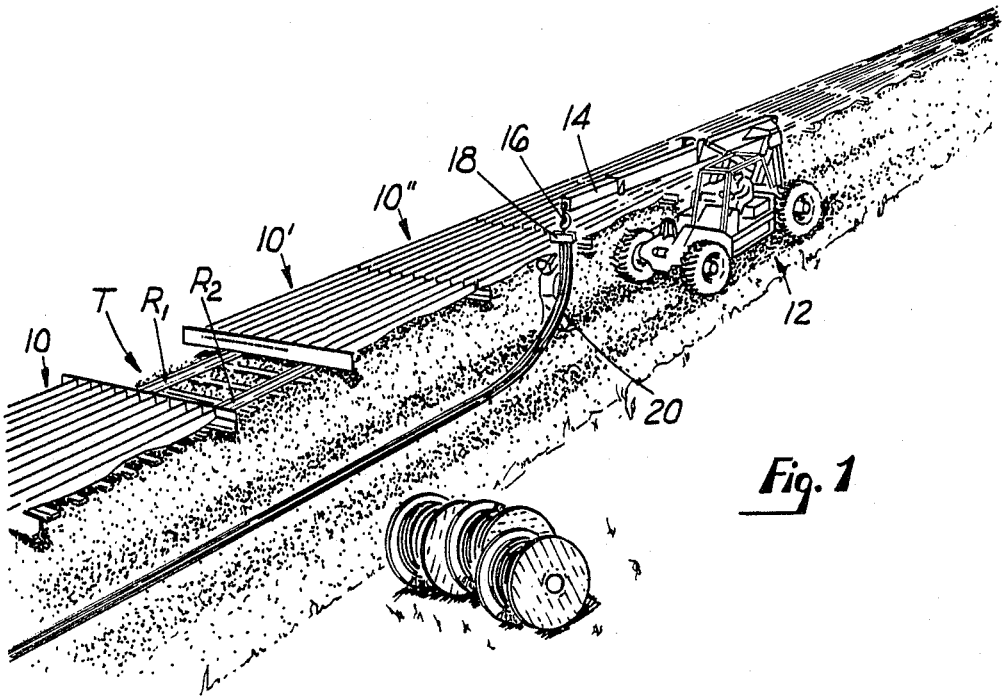
FIG. 1 is a schematic perspective view of the manufacture of prestressed concrete railroad ties on an existing railroad track.

In FIG. 1 a series of prestressed concrete molds 10, 10', 10'', are shown supported upon a railway car track T having rails R1 and R2. A suitable tractor vehicle 12 includes an outstanding boom 14 having a hook 16 which engages a transverse plate assembly 18, which supports a series of reinforcing strands 20 to be placed into the molds 10, 10', 10''.

Figure 5:
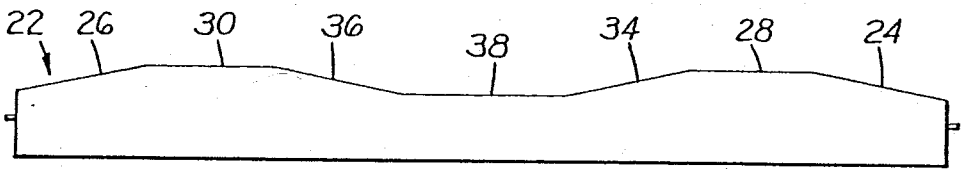
FIG. 5 is a view of a formation of the concrete ties bottoms up.

As described in U.S. Pat. No. 4,712,735 incorporated into the present application by this reference and in FIGS. 5–7, the prestressed concrete ties 22 include inclined end portions 24 and 26, flat portions 28 and 30, for support of the rails, second inner inclined portions 34 and 36, and a center horizontal portion 38. The strands 20 are located within the tie at a position close to the neutral axis to minimize stress fluctuations. In addition, this contour minimizes the amount of concrete required to construct a suitable tie to carry the loads applied by railcar locomotives and cars passing over the horizontal portions 28 and 30.

Figure 3:
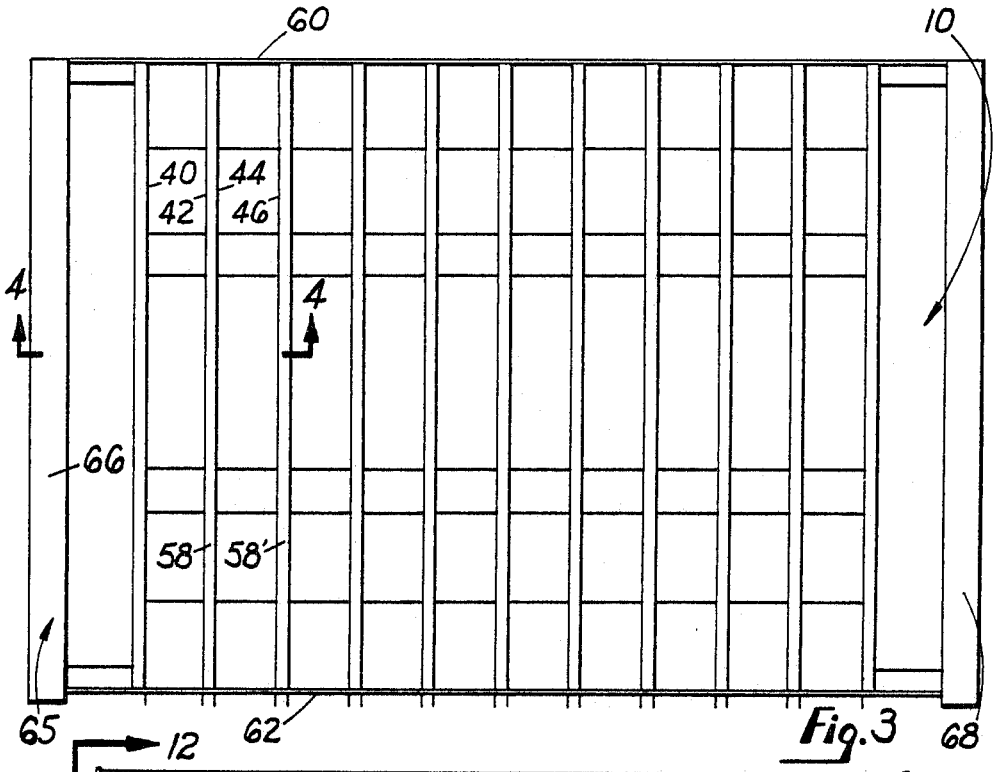
FIG. 3 is a plan view of the mold utilized in the present invention.
Figure 4:
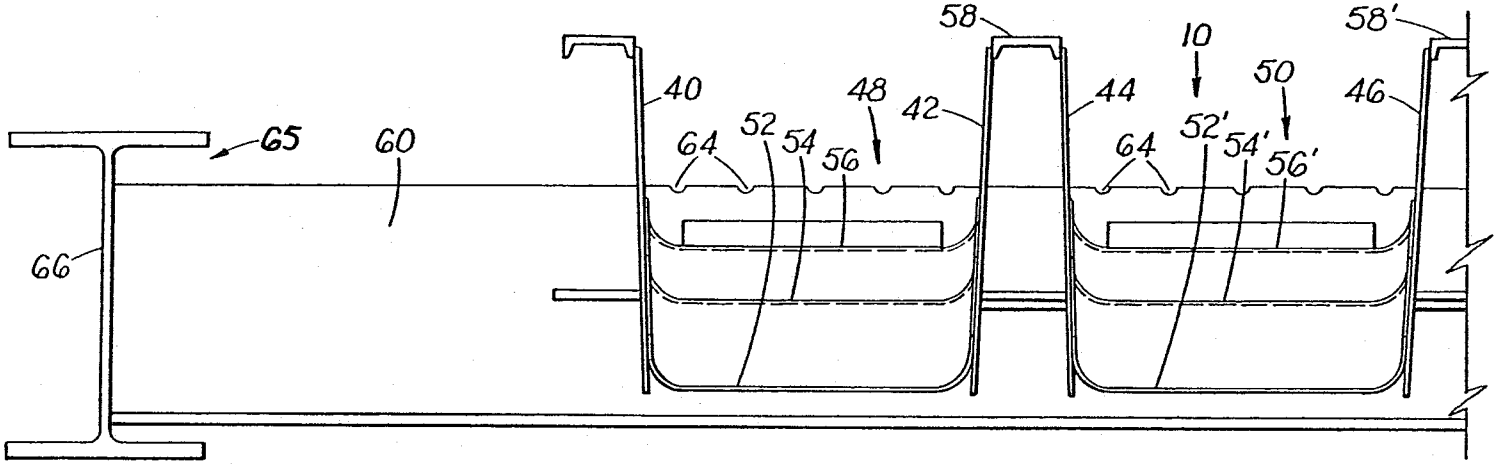
FIG. 4 is a sectional view through the mold of the present invention.
Figure 6:
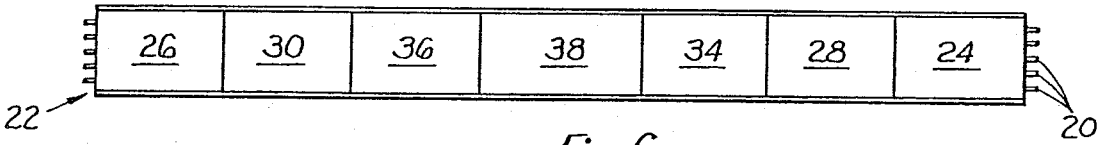
FIG. 6 is a plan view of FIG. 5.
Figure 7:
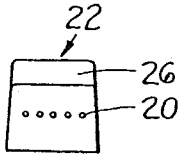
FIG. 7 is an end view of FIG. 5.

The molds 10 in FIGS. 4 and 6 include a series of inclined vertical plates 40, 42, 44, and 46. One concrete tie is formed in a chamber 48 between plates 40 and 42, and another concrete tie is formed in a chamber 50 between plates 44 and 46. In the molds the various sections of the tie 24, 26, 28, 30, 36 and 38 are formed bottoms up in the molds. Thus the thick portions 28 and 30 are formed in the portion of the mold 52 where the molds are thickest. The line 54, 54' denotes the formation of inclined portions 24, 26. The thin center portion 38 is formed at the level 56, 56'. Spacers 58, 58' separate respective chambers 48 and 50 etc. in the mold. The mold (FIGS. 3 and 4) further includes end plates 60 and 62 which are provided with a series of slots 64, 64' to receive the strands 20. The height of the plates 60 and 62 is such as to locate the strands 20 very close to the neutral axis of the section as described above and in the said U.S. Pat. No. 4,712,735 incorporated into the present application by reference.

At either side of the molds, mold stabilizing and lifting means indicated generally at 65 is provided. Preferably, this stabilizing means comprises a pair of I-beams 66 and 68 located on each side of the molds. End plates 60 and 62 are welded to these stabilizing I-beams.

Figure 2:
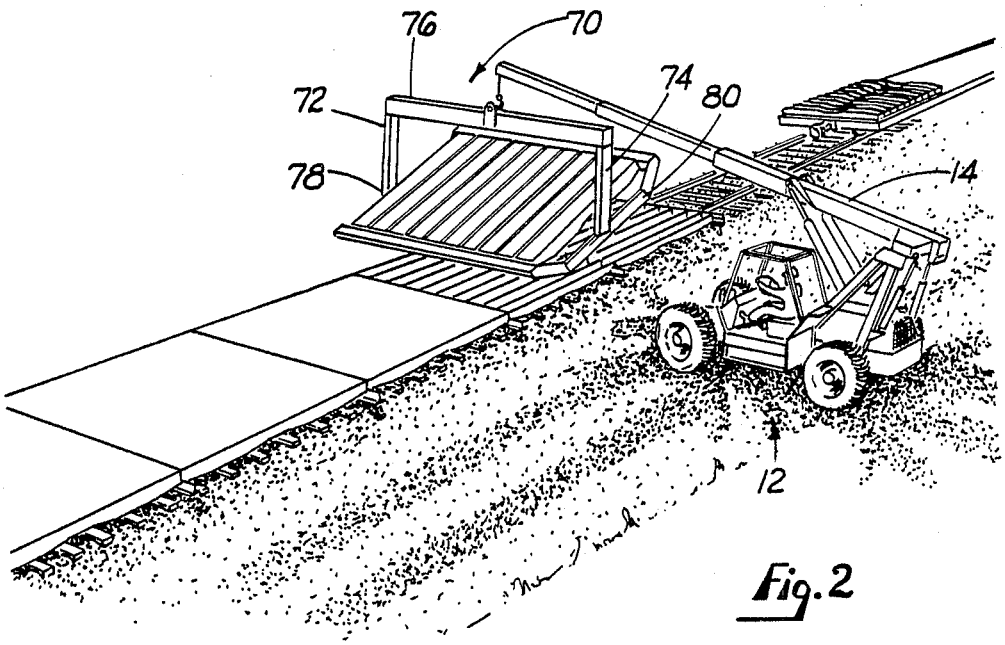
FIG. 2 is a schematic perspective view of the extractor of the present invention lifting a mold containing prestressed concrete ties.
Figure 8:
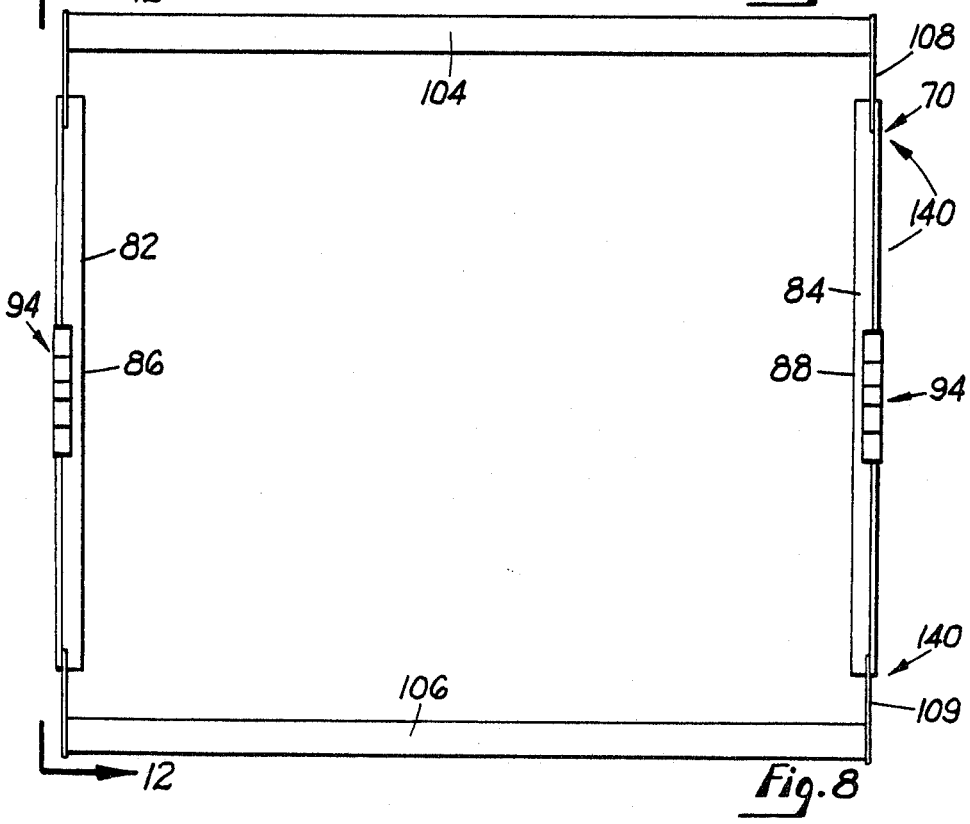
FIG. 8 is a plan view of the extractor of the present invention.

The mold extractor 70 in FIGS. 2, 8 and 9 includes a pair of laterally spaced vertically extending yoke arms 72 and 74 which are joined by a transversely extending support beam 76. A pair of laterally extending yoke shafts 78 and 80 are attached integrally to each vertical yoke. Laterally spaced extractor side beams 82 and 84 include vertically foreshortened portions 86 and 88 which receive rotatable disks or wheels 90 integrally connected to the yoke shafts 78 and 80 as illustrated in FIG. 9. On each side of the extractor connecting rods 92 are attached to the wheels and are pivotably mounted upon the extractor side beams 82 and 84.

Cushioning means 94 are located between the connecting rods 92 and the pivot point 93. The connecting rod 92 is connected to a piston 96 which extends into a cylinder 98. Piston 96 has a piston head 100 located within the cylinder 98. An orifice 102 may be provided in piston head 100 to allow the path of hydraulic fluid there through in a controlled manner to effect cushioning in a known manner.

At each end of the extractor, transverse beams 104 and 106 extend transversely across the extractor. Plates 108 extend from the angles beams 86 and 88 to the transverse beams 104 and 106. In addition, end gussets 110 also provide support for angle 84. Angle 84 has upper flanges 84a upon which rest the wheels or disks 90. Similarly, inclined portion 88a has an upper flange **88*b***.

A series of fixed links 112 and a series of movable links 114 are attached to respective beams 104 and 106. Each of the fixed and movable links 112, 114 includes a respective finger 116 and 118, each provided with a complimentary slot to receive a reinforcing strand indicated at 20 in FIGS. 6 and 7. Thus an assembly of fixed links and fingers 112, 116 and movable links and fingers 114 and 118 is provided for each strand 20. The movable links are pivoted about a point 120 on beams 104 and 106.

Actuating means 122 for moving the movable links and thus the movable fingers into engagement with the fixed fingers and strands is provided. The actuating means 122 may include a rod 124 connected to an opposite end portion 126 of each movable link. The actuating means moves the rod 124 such as to pivot the movable links 114 about the beam 106 and move the movable fingers 118 into engagement with the fixed fingers 116.

In one embodiment the rod 124 (FIG. 10) is connected at one end to a yoke 128 having a slot therein 130 adapted to receive a wedge means 132 including a wedge member 134 insertable by the attendant into the slot to move the rod 124 transversely of the extractor and pivot the movable links 114 about the beam 106 and thus move the movable fingers 118 into engagement with the fixed fingers 116 and the strands 12. Resilient means 136 are provided to provide that the applied force applied to each movable link by the rod 24 is generally about the same. For example, these resilient means may comprise a plurality of Belleville springs 138.

After the strands in a given mold have been severed at the end of the mold, the crane means 14 operated from the tractor 12 lifts the extractor 70 and the group of ties from the mold 10 (FIGS. 1 and 2).

Preferably the extractor 70 includes support means (FIGS. 3, 8 and 10) 140 which allows the extractor to rest on the mold, for example, on ends 60 and 62 to clamp the strands in place. The support means as described above includes plates 108 and 109 attached to the respective ends of beams 82 and 84. The center of gravity of the extractor 22 is as illustrated in FIG. 12 with the ties upside down is such that the assembly of the extractor and ties is biased to be rotated from the position shown in FIG. 12 to an inverted position 180° away from the position shown in FIG. 12 with the ties in the second position being upright and ready for transfer to the point of use.

After the ties have been released the center of gravity is again shifted 180° and the apparatus will rotate back to position shown in FIG. 12.

In the operation of the invention, as shown in FIG. 1, a series of molds are placed upon existing track generally adjacent or near the place where the new concrete ties are to be utilized. This reduces cost of shipping the ties a significant distance. The existing track T with the rails R1 and R2 provides a support for the molds 10, 10', 10'', etc. which are located on the track. The molds (FIGS. 3 and 5) form the ties upside down with the thick portions 28 and 30 being formed at 52, 52', the inclined intermediate portions 24, 34, 36 and 26 formed at 54 and 54' and the thinner middle portions 38 being formed by the mold portions 56, 56'. At the ends of the molds the plates 60 and 62 contain the slot 64, 64' for the strands. The strands are located within the molds through the use of the tractor 12 and the lifting arm 14 as illustrated in FIG. 1.

After the strands are located within the molds in the slots 64, 64', the strands are tightened in place with hydraulic cylinders. The cylinders are reacted against the mold, causing mold to foreshorten. The concrete is poured into the molds and the ties are formed. Conventional concrete mixers are used and the concrete is mixed and poured in a conventional manner.

After the concrete has reached a predetermined strength (FIGS. 1, 3, 8 and 10) the strands extending between adjacent molds 10, 10', 10'' are manually severed. The molds then elongate back to original length. Also, the ties shrink due to tension in the strands. This breaks the bond between tie and mold facilitating removal. Extractor 70 is lowered by means of the tractor 12 and the boom 14 into position with the support beams 104 and 106 at the ends engaging the ends 60, 62, but inboard of the I-beams 64 and 68. With the extractor located in place upon the mold 10, fingers 116 and 118 are located adjacent the outwardly extending severed strands 20. Actuating means 122 is actuated by the attendant and this forces the movable links 114 and the movable fingers 118 into engagement with the strands and with the fixed fingers 116. The attendant then lifts the extractor and ties as illustrated in FIG. 2. As illustrated in FIG. 12, the center of gravity of the assembly of the extractor ties is such that this assembly has a center of gravity C.G. above pivot point 150. This unstable condition will cause 180° rotation of the assembly, and position the ties in upright position. Thus upon lifting with the boom 14 the assembly will rotate 180° without mechanical assistance.

Furthermore, when the ties are released, the center of gravity once again shifts above pivot 150, causing the empty extractor to position as shown in FIG. 12, ready for another cycle.

After the ties have been installed in the railroad adjacent the temporary site of manufacture, as described hereinabove, the apparatus may be moved to an entirely different location adjacent the same or another track where new repair ties are required.

The above described process is then repeated in this new site, and ties are formed, and taken to an adjacent installation site and installed into the track.

After the process is carried out at this second site, the process may be repeated indefinitely at an indefinite number of track sites adjacent the location where ties are to be installed.

Thus the cost of shipping the ties long distances is avoided with the process and apparatus of the present invention.

The present invention further avoids the cost of fabrication of a permanent plant at a fixed location, which is a significant reduction in cost of plant construction.

I claim:

1. A mold assembly for the manufacture of prestressed concrete railroad ties comprising:

prestressed concrete molds supported by existing track near the area where the ties are to be installed;

each mold having a plurality of components to form a number of ties including transverse end portions of each mold having means to locate reinforcing strands within each tie at a single level at a position sufficiently close to a neutral axis to minimize stress fluctuations; wherein each mold has a bottom that is contoured with inclined portions to provide a desired tie cross section which varies in a manner designed to carry the compressive and tensile loads applied to the tie by the wheels of rail cars and at the same time minimize the amount of concrete required;

means for pouring concrete into the mold;

extractor means for removing a group of ties simulatenously from a given mold;

said extractor means having means for simultaneously clamping the reinforcing strands extending outwardly from a given mold and means for lifting the strands as a group from the mold.

2. A mold assembly according to claim 1, wherein the center of gravity of said extractor means, when loaded with a groups of ties, is located such that the group of ties will automatically rotate 180 degrees to locate the ties in an upright position.

3. A mold assembly according to claim 2, including means for loading the ties on a railway car or other vehicle to take them to the site where they are to be installed.

4. A mold assembly according to claim 1, wherein the transverse end portion of each mold defines slots to receive the prestressed ties.

5. A mold assembly according to claim 4, wherein spacer means separate individual tie mold patterns.

6. A mold assembly according to claim 4 wherein stabilizing support means are provided at each side of the mold.

* * * * *